US011014730B2

(12) United States Patent
Chaturvedi

(10) Patent No.: US 11,014,730 B2
(45) Date of Patent: May 25, 2021

(54) METHOD OF MAKING PACKAGE WITH INTEGRATED HANDLE ON SIDE GUSSET AND A PACKAGE THEREOF

(71) Applicant: Ashok Chaturvedi, New Delhi (IN)

(72) Inventor: Ashok Chaturvedi, New Delhi (IN)

( * ) Notice: Subject to any disclaimer, the term of this patent is extended or adjusted under 35 U.S.C. 154(b) by 0 days.

(21) Appl. No.: 15/319,866

(22) PCT Filed: Jun. 18, 2015

(86) PCT No.: PCT/IN2015/000248
§ 371 (c)(1),
(2) Date: Dec. 19, 2016

(87) PCT Pub. No.: WO2015/193914
PCT Pub. Date: Dec. 23, 2015

(65) Prior Publication Data

US 2017/0129677 A1 May 11, 2017

(30) Foreign Application Priority Data

Jun. 18, 2014 (IN) ..... 1641/DEL/2014

(51) Int. Cl.

| | |
|---|---|
| ***B65D 75/56*** | (2006.01) |
| ***B65D 30/20*** | (2006.01) |
| ***B65D 33/10*** | (2006.01) |
| ***B65D 33/06*** | (2006.01) |

(Continued)

(52) U.S. Cl.
CPC ..... *B65D 75/563* (2013.01); *B65D 31/10* (2013.01); *B65D 33/065* (2013.01); *B65D 33/10* (2013.01);

(Continued)

(58) Field of Classification Search
CPC ..... B65D 75/563; B65D 31/10; B65D 33/10; B65D 33/065; B31B 2219/908;

(Continued)

(56) References Cited

U.S. PATENT DOCUMENTS 5,026,173 A * 6/1991 Jensen ..... B65D 33/06 383/10
5,048,976 A * 9/1991 Jung ..... B65D 33/08 383/10

(Continued)

FOREIGN PATENT DOCUMENTS

EP 1777167 B1 3/2009
EP 2035288 A1 3/2009

(Continued)

OTHER PUBLICATIONS

Indian Patent Office, International Search Report and Written Opinion issued in corresponding Application No. PCT/IN2015/000248, dated Dec. 3, 2015.

*Primary Examiner* — Jes F Pascua
(74) *Attorney, Agent, or Firm* — Dinsmore & Shohl, LLP

(57) ABSTRACT

A method (100) of making an integrated handle (304) on at least one side gusset (308) of a flexible package (300) is provided. The method (100) includes steps of sealing a handle patch (222) on at least one half width of the side gusset laminate (218). Further, the method (100) provides parallel openings on the handle patch (222) such that a centre line of the two parallel openings coincides with centre lines of each half of the side gusset laminate (218). A cover patch (226) is sealed over the handle patch (222) overlapping the edges of the handle patch (222) and simultaneously with the side gusset laminate (218) all around, such that a predefined area is left unsealed between the two parallel openings. The longitudinal edges of the side gusset laminate (218) are folded such that the handle patch (222) comes on the outer surface of the continuous open tube (242) being formed. The continuous open tube (242) is thereby used for manufacturing the flexible package (300).

9 Claims, 5 Drawing Sheets

(51) Int. Cl.
*B31B 160/20* (2017.01)
*B31B 70/86* (2017.01)
*B31B 155/00* (2017.01)

(52) U.S. Cl.
CPC ..... *B31B 70/866* (2017.08); *B31B 70/876* (2017.08); *B31B 2155/00* (2017.08); *B31B 2155/002* (2017.08); *B31B 2160/20* (2017.08)

(58) Field of Classification Search
CPC ..... B31B 2219/9096; B31B 2237/20; B31B 70/876; B31B 2155/00; B31B 2155/002; B31B 2160/20; B31B 70/866
USPC ..... 383/20, 21, 120, 10, 116
See application file for complete search history.

(56) References Cited

U.S. PATENT DOCUMENTS 7,775,957 B2 * 8/2010 Totani ..... B65D 31/10 493/189
8,322,923 B2 12/2012 Gum
8,844,246 B2 * 9/2014 Perick ..... B65D 75/566 53/413
9,493,272 B2 * 11/2016 Hoedebeck ..... B65D 31/10
9,533,463 B2 * 1/2017 Gum ..... B65D 75/563
2008/0080794 A1 * 4/2008 Kruse ..... B65D 33/10 383/14
2009/0202181 A1 * 8/2009 Alaux ..... B65D 31/10 383/7
2011/0033133 A1 * 2/2011 Kujat ..... B65D 31/10 383/20
2015/0049965 A1 * 2/2015 Gum ..... B65D 75/563 383/120
2017/0361994 A1 * 12/2017 Bruns ..... B65D 33/06

FOREIGN PATENT DOCUMENTS

EP 2039620 A1 3/2009
FR 2907428 A1 * 4/2008 ..... B65D 33/065
WO 2008/020139 A1 2/2008
WO 2009095806 A2 8/2009

* cited by examiner

METHOD OF MAKING PACKAGE WITH INTEGRATED HANDLE ON SIDE GUSSET AND A PACKAGE THEREOF

FIELD OF THE INVENTION

The invention generally relates to flexible packages and more particularly relates to such flexible packages with handle on the side gusset.

BACKGROUND OF THE INVENTION

In the field of flexible packaging for bulk packages (or bags), consumers face problem in carrying the packages from one place to another. The reason being either the bulk packages do not have handle or handles are positioned at the top requiring consumer to lift the longer bags sufficiently so as to prevent it from touching the ground. In these flexible packages consumer also faces problem that the handle being not designed ergonomically so as to help the consumer in dispensing the products.

Handles of these packages are generally located at the top and are attached as a patch which does not provide enough strength for carrying and therefore gets detached most of the time.

Therefore, there exists a need to develop a flexible bulk package and method of manufacturing such flexible bulk packages which can have ergonomically designed handle that is easy to carry and stronger enough which also provide easy carrying of the flexible bulk packages.

SUMMARY OF THE INVENTION

According to an aspect of the present invention, a method of making an integrated handle on at least one side gusset of a flexible package is provided. The method includes steps of sealing a handle patch on at least one half width of the side gusset laminate. Further, the method includes the step of providing parallel openings on the handle patch such that a centre line of the two parallel openings coincides with centre lines of each half of the side gusset laminate. The method further includes sealing a cover patch over the handle patch overlapping the edges of the handle patch and simultaneously sealing with the side gusset laminate all around, such that a predefined area is left unsealed between the two parallel openings. Furthermore, the method includes the step of folding longitudinal edges of the side gusset laminate such that the handle patch comes on the outer surface of the continuous open tube being formed. The continuous open tube is thereby used for manufacturing the flexible package with handle on the at least one side gusset.

BRIEF DESCRIPTION OF THE DRAWINGS

The advantages and features of the invention shall be better understood with reference to the following description taken in conjunction with the accompanying drawing, wherein like elements are identified with like symbols and in which.

Like reference numerals refer to like parts throughout the description of several views of the drawings.

DETAILED DESCRIPTION OF THE INVENTION

For a thorough understanding of the invention, reference is to be made to the following detailed description in connection with the above-mentioned drawings. Although the invention is described in connection with invention, the invention is not intended to be limited to the specific forms set forth herein. It is understood that various omissions and substitutions of equivalents are contemplated as circumstances may suggest or render expedient, but these are intended to cover the application or implementation without departing from the spirit or scope of the invention. Further, it will nevertheless be understood that no limitation in the scope of the invention is thereby intended, such alterations and further modifications in the figures and such further applications of the principles of the invention as illustrated therein being contemplated as would normally occur to one skilled in the art to which the invention relates. Also, it is to be understood that the phraseology and terminology used herein is for the purpose of description and should not be regarded as limiting. Further, reference herein to "one embodiment" or "an embodiment" means that a particular feature, characteristic, or function described in connection with the embodiment is included in at least one embodiment of the invention. Furthermore, the appearances of such phrase at various places herein are not necessarily all referring to the same embodiment. The terms "a" and "an" herein do not denote a limitation of quantity, but rather denote the presence of at least one of the referenced item. Moreover, the term "inner surface/layer" used herein above and/or below may be interchangeably used as an "inner surface" or an "inner layer" throughout the invention. Further, the term "outer surface/layer" used herein above and/or below may be interchangeably used as an "outer surface" or an "outer layer" through.

The invention provides a method for manufacturing an integrated handle on its side gusset, including the steps of sealing a handle patch on at least one half across the width of a side gusset laminate; slitting or punching parallel openings on the handle patch such that centre line of the two parallel openings coincides the centre line of each half; sealing a cover patch over the handle patch leaving substantial area between the two parallel openings unsealed; folding the edges of the side gusset laminate forming a continuous tube over a bottom web across its width; advancing the bottom web for further operations of making the flexible package; slitting side gusset tube, configured between the top web and the bottom web, in the middle to get two consecutive flexible packages, at least one of them having the integrated handle.

Figure 1:
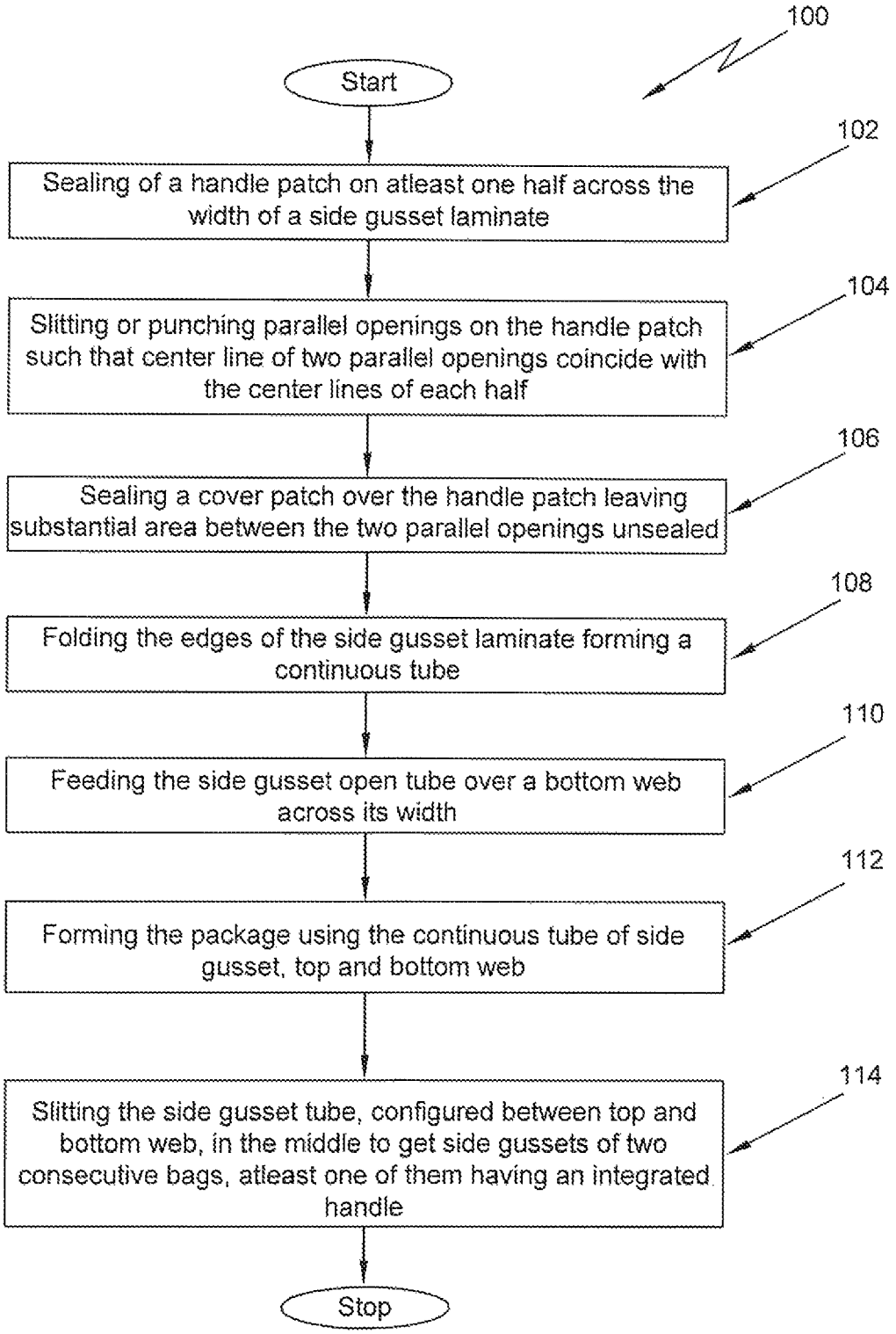
FIG. 1 illustrates an exemplary flowchart depicting a method of manufacturing a package with integrated handle on its side gusset, in accordance with an embodiment of the present invention.
Figure 2A:
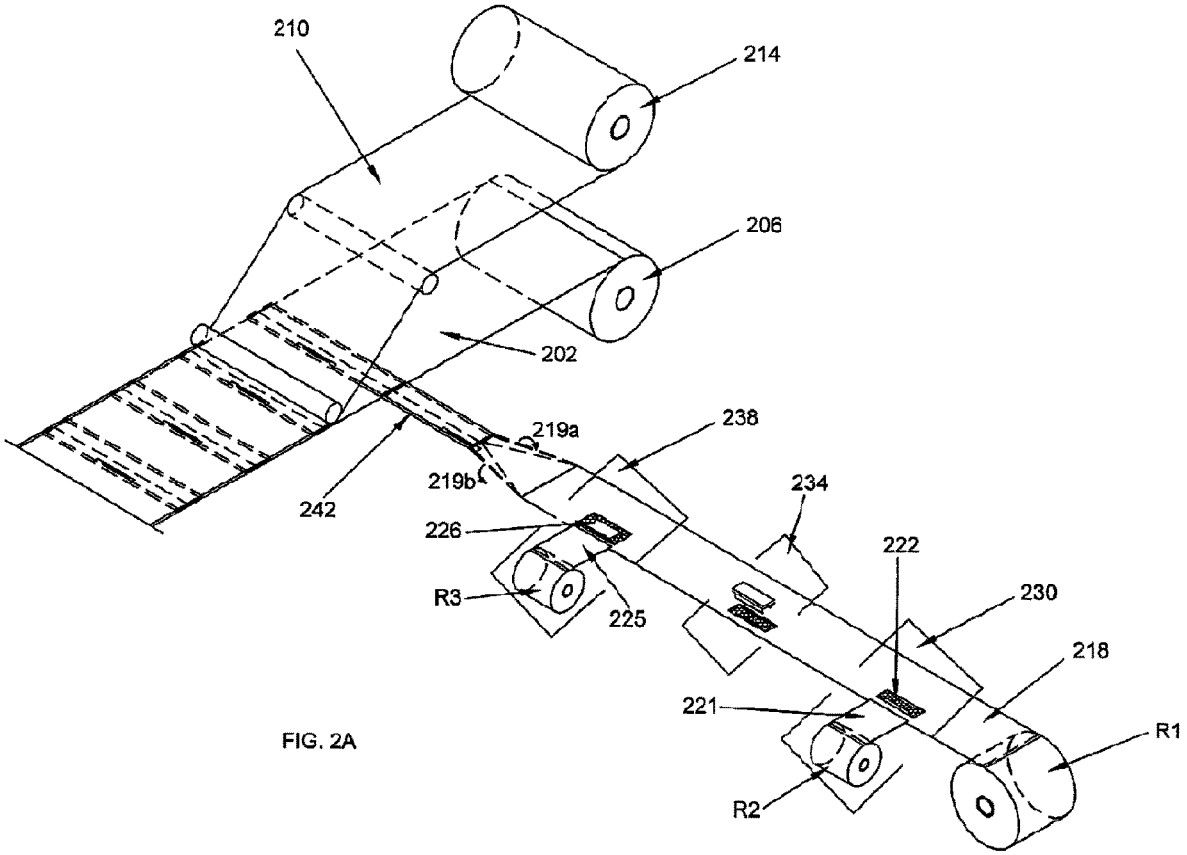
FIG. 2A illustrates a diagrammatic representation of the method of manufacturing of the package with integrated handle on its side gusset, in accordance with an embodiment of the present invention.

FIG. 1 is a flowchart illustrating a method (100) for making and feeding a continuous open tube of side gusset laminate for manufacturing a flexible package having an integrated handle on its side gusset in accordance with an embodiment of the present invention. Further, FIG. 2A illustrates a diagrammatic representation of the method (100) of making and feeding the continuous open tube for manufacturing the flexible package with the integrated handle on its side gusset.

Initially, at step (102) a handle patch (222) is sealed on a side gusset laminate (218), in the middle of at least one half, across the width of the side gusset laminate (218). The side gusset laminate (218) is pulled from a first roll (R1). It may be contemplated that similar to the side gusset laminate (218), a top web (210) and a bottom web (202) may also be pulled from a first and a second unwinder (214, 206) respectively. It may be contemplated that the invention is related specifically to the sealing of handle patch (222) onto the side gusset laminate (218), therefore, other details about the top and the bottom webs (210, 202) respectively is not disclosed in greater details. According to an embodiment of the present invention, the handle patch (222) is pulled from a second roll (R2) as shown in FIG. 2A. It may be well understood by a person skilled in the art that the three webs of top (210), bottom (202) and side gussets (218) may be pulled simultaneously or in any specific order at a single station.

At step (104) two parallel openings are provide on the handle patch (222). In an embodiment, the parallel openings are slit or punched such that a center line of the two parallel openings coincide with center lines of each half of the width of side gusset laminate (218).

Further, at step (106), a cover patch (226) is sealed over the handle patch (222) such that a predefined area is left unsealed between the two parallel openings (L1, L2). At step (108) folding the edges of side gusset laminate (218) downwards is done such that the handle patch (222) is on the outer surface, thereby forming a continuous open tube (242).

At step (110) the continuous open tube (242) is fed over the bottom web (202) across the width of the bottom web (202). Alternatively the continuous open tube (242) is first cut with a cutter (248) to a length equal to the length of the desired package and then the cut piece is fed over the bottom web (202) (see FIG. 2D). Furthermore, at step (112) advancing of the bottom web (202) for further operations for forming a flexible package is done. The formation of the flexible package using the top web (210), the bottom web (202) and the side gusset (218) is known in the art and one such method is explained in Indian Patent Application No. 1448/DEL/2007. Therefore, the detailed steps of making the flexible package are not explained here for the sake of brevity. It may be well understood, that the attaching of the handle patch (222) onto the side gusset laminate (218) is the focus of the present invention.

Furthermore, at step (114) the side gusset tube (242) is slit and configured between top and bottom web, in middle to get side gussets of two consecutive flexible packages, at least one of them having the integrated handle, is done.

Figure 2B:
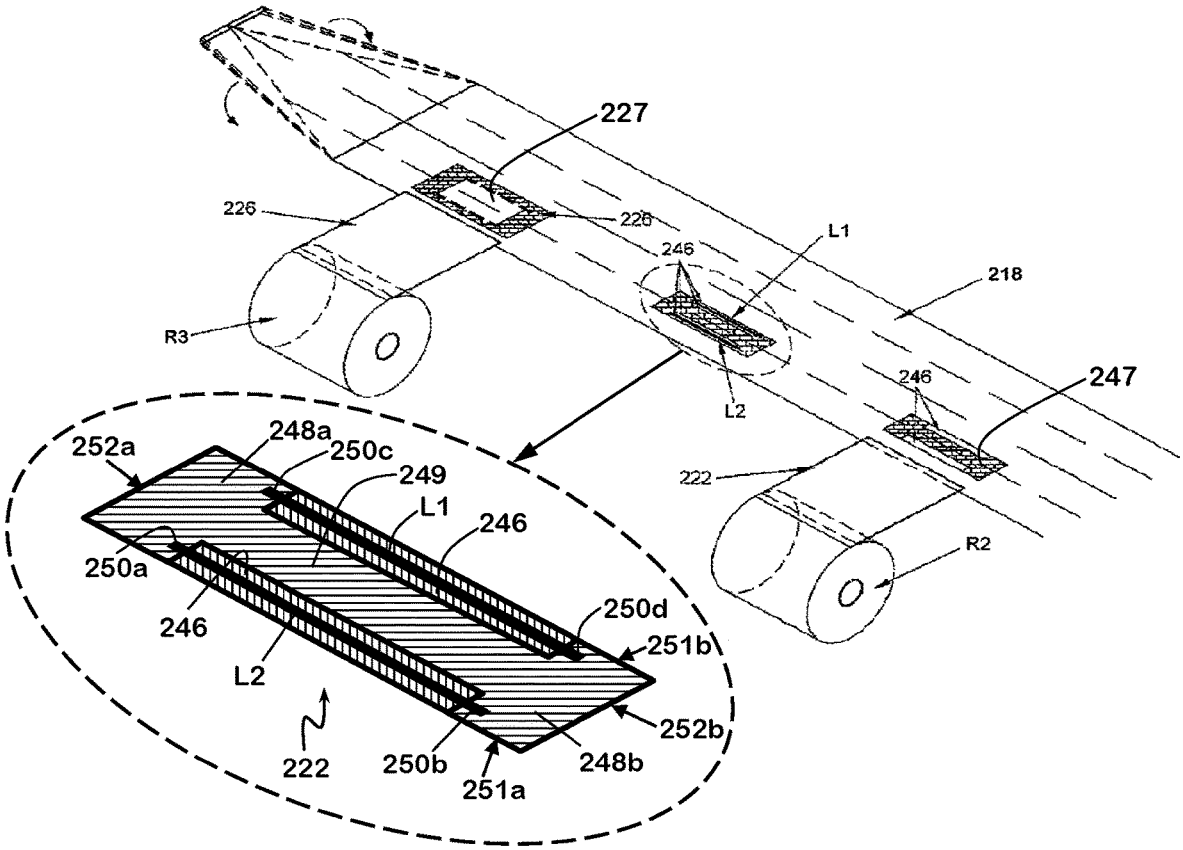
FIG. 2B illustrates an enlarged view of the formation of a side gusset open tube before being fed over a bottom web, according to an embodiment of the present invention.

As shown in FIGS. 2A and 2B, the side gusset laminate (218) first advances to a handle patch sealing station (230), where the handle patch (222) is cut and sealed to the side gusset laminate (218) at the middle of one half width of the side gusset laminate (218). The sealing punch and die are so designed to provide a sealed area (247) of the handle patch (222) that is sealed with the side gusset laminate (218) and further to provide unsealed side areas (246) along the length of the handle patch (222) that remain unsealed with the side gusset laminate (218) along portions of lateral edges (251*a* and 251*b*) of the handle patch (222). The sealed area (247) of the handle patch (222) includes end portions (248*a* and 248*b*) adjacent to opposite ends (252*a* and 252*b*) of the handle patch (222) and sealed to the side gusset laminate (218) across the entire width of the handle patch (222). The sealed area (247) of the handle patch (222) further includes a center portion (249) connecting the end portions (248*a* and 248*b*) between the unsealed side areas (246). The cutting and sealing mechanism can be any mechanism available and suitable for the purpose.

According to various embodiments of the present invention, the side gusset laminate (218) is made up of at least one of or a combination of a polymeric film, a metal foil, a laminate and a fibrous substrate. The fibrous substrate may include paper (coated or uncoated), paperboard, non-woven or woven substrate of synthetic fibers or tapes. The side gusset laminate (218) may be provided with at least one polyethylene layer on at least one side to seal the side gusset laminate (218) to the handle patch (222) and the cover patch (226).

Further, the handle patch (222) can be made up of polyethylene film or multilayer film/laminate with both side polyethylene layers.

Figure 3:
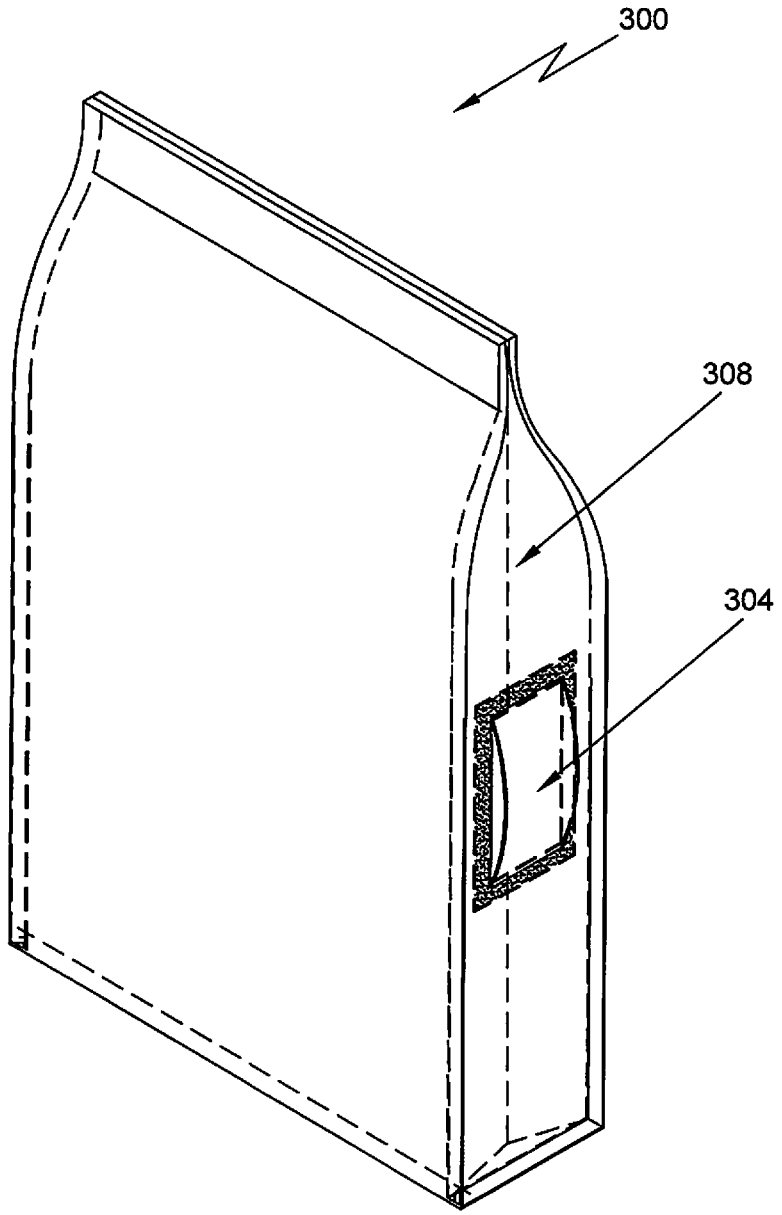
FIG. 3 shows the exemplary package with an integrated handle on its side gusset, in accordance with an embodiment of the present invention.

Further, the side gusset laminate (218) advances to a slitting/punching station (234), where two lines/slots, two parallel openings (L1 and L2) are slit/punched on the handle patch (222) (as shown in FIGS. 2A and 2B) to form a handle (304) (as shown in FIG. 3). The slitting/punching of the two parallel openings (L1 and L2) is positioned over the unsealed side areas (246) along the length of the handle patch (222) resulting in having separate layers of side gusset laminate (218) and handle patch (222) near the edges of the two parallel openings (L1 and L2). This provides soft feeling of handle edges. The punching can be done by any process known in the art, such as die punching.

Again as shown in FIGS. 2A and 2B, the side gusset laminate (218) further advances to a cover patch sealing station (238) where the cover patch (226) is released from a third roll (R3). It may be contemplated that the cover patch (226) is slightly bigger than handle patch (222) all around, and is further sealed over the handle patch (222) overlapping the edges of the handle patch (222) and simultaneously sealing with the side gusset laminate (218) all around. The cover patch (226) sealing punch & die are so designed that a substantial area (227) of the cover patch (226) in between the two lines (L1 and L2) along the length of the handle patch (222) remains unsealed to the handle patch (222). However, the lengths of the unsealed side areas (246) of the handle patch (222) are smaller than the lengths of the two parallel openings (L1 and L2) so that the end portions (248*a* and 248*b*) of the sealed area (247) of the handle patch (222) overlap each of the ends (250*a*, 250*b*, 250*c*, 250*d*) of the two parallel openings (L1 and L2), as shown in FIG. 2B. This provides extra strength to the handle ends avoiding tearing under lifting load. The sealing process can be any method known in the art and suitable for the purpose such as heat sealing, ultrasonic sealing, adhesive sealing, hot melt adhesive sealing, etc. According to the various embodiments of the present invention, the cover patch (226) may be made up of film of polyethylene or multilayer film/laminate having polyethylene layer at least on one side. It may be contemplated that the polyethylene side is configured to be sealed with handle patch (222) and side gusset laminate (218).

FIG. 2B shows the diagrammatic view of the operations at handle patch sealing station (230), slitting station (234) and the cover patch sealing station (238). At the handle patch sealing station (238), the handle patch (222) is sealed at the centre line of the two halves across the width of side gusset laminate (218).

At the slitting station (234), the slitting/punching of the two parallel openings (here (L1 and L2)) are done in such a manner that the center line between the two parallel openings (L1 and L2) coincides with the center line of the each half across the width of the side gusset laminate.

After sealing of the cover patch (226), the side gusset laminate (218) is folded over the former (shown by arrows 219*a*, 219*b*) with edges of the side gusset laminate (218) folding in vertically downward direction and thereby forming the continuous open tube (242). In particular, the side gusset laminate (218) is center folded pinched in such a manner that the creasing lines pass through the middle of width of the handle (304).

In some embodiments if there is a requirement of two handles on both the sides of the package, the handle patch sealing station (230), the slitting/punching station (234) and the cover patch sealing station (238) must also be placed on other side of the side gusset laminate (218) performing similar operations.

The continuous open tube (242) is further fed, sealed and cut over the bottom web (202). The feeding over the bottom web (202) is done in such a manner that the open end of the continuous open tube (242) faces the bottom web (202). The top web (210) is further sealed over the side gusset open tube (242) subsequently.

Figure 2C:
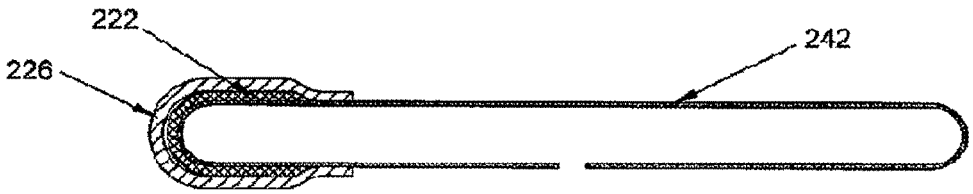
FIG. 2C shows a side view of the side gusset open tube, in accordance with an embodiment of the present invention.
Figure 2D:
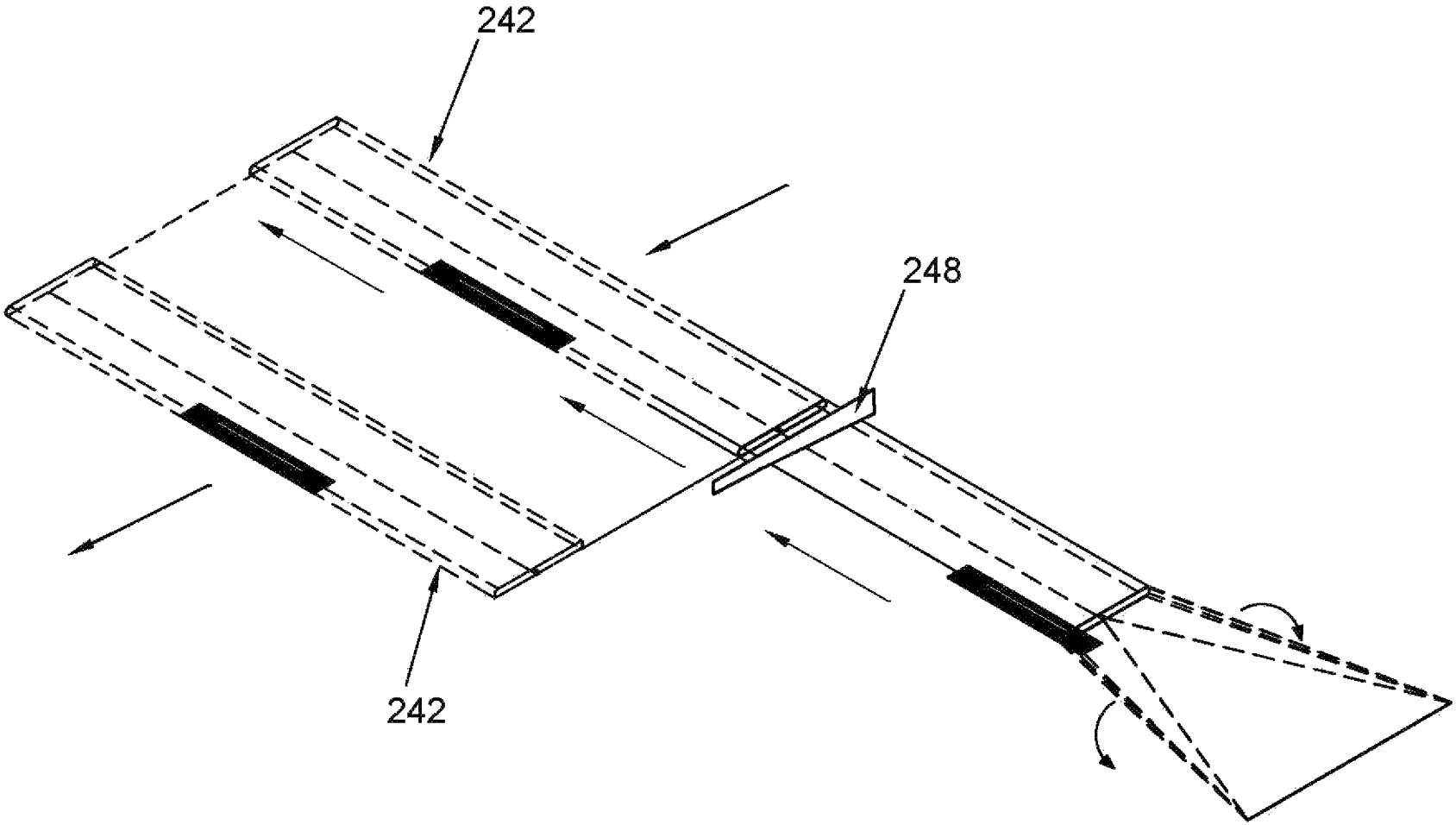
FIG. 2D illustrates an enlarged view of the formation of a side gusset open tube before being fed over a bottom web, according to another embodiment of the present invention.

The open gusset tube (242) having the handle patch (222) and the cover patch (226) which is configured between the bottom web (202) and the top web (210), is shown in FIG. 2C.

A flexible package (300) having the integrated handle (304) on one of its side gussets (308) obtained by using method (100) is shown in FIG. 3. To adjust the position of the integrated handle (304) the position of the handle patch (222) and cover patch (226) is required to be adjusted accordingly. According to the various embodiments of the present invention, the flexible package (300) may be made from at least one or in combination(s) of a polymeric film, a metal foils, a laminate and a fibrous substrate. The fibrous substrate can be at least one of a natural fibre substrate like paper (coated or uncoated), paperboard, non-woven, woven substrate of synthetic fibres or tapes. The polymeric film can be of Bio-degradable material.

Further operations for the formation of flexible package are available in the prior art and further operations are not claimed hence not mentioned to maintain the brevity. Further, it may be contemplated that the bottom of the flexible package is permanently closed, with flat or gusseted bottom and other end of the flexible package can also be closed after filling the product or can have opening closing means like zipper slider or can have re-sealable tape closing or any other fixed or re-sealable means.

The invention is advantageous in manufacturing the package (300) having the integrated handle being stronger, as the handle (304) is integral part of the side gusset further strengthened with the adhesion of second layer as handle patch (222). Handle on the side gusset makes carrying of longer packages easy. Since the handle is positioned ergonomically that can help in dispensing of the products easily.

The foregoing descriptions of specific embodiments of the invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the invention.

I claim:

1. A method of making a flexible package having an integrated handle on at least one side gusset of the flexible package, the method comprising:

sealing a handle patch to a side gusset laminate at middle of one half width of the side gusset laminate, such that the sealing provides a sealed area of the handle patch that is sealed to the side gusset laminate and further provides unsealed side areas of the handle patch along portions of lateral edges of the handle patch, the unsealed side areas remaining unsealed to the side gusset laminate, the sealed area comprising end portions adjacent to opposite ends of the handle patch and a center portion connecting the end portions between the unsealed side areas;

providing two parallel openings on the handle patch such that center lines of the two parallel openings coincide with center lines of each half of the side gusset laminate, each parallel opening having two ends, the two parallel openings being positioned over the unsealed side areas of the handle patch, wherein lengths of the unsealed side areas of the handle patch are smaller than lengths of the parallel openings, whereby the end portions of the handle patch overlap each of the ends of the two parallel openings;

sealing a cover patch over the handle patch on the side gusset laminate overlapping the edges of the handle patch all around but not overlapping an entire width of the side gusset laminate, such that a predefined area of the cover patch is left unsealed between the two parallel openings;

folding longitudinal edges of the side gusset laminate such that the handle patch comes on an outer surface of a continuous open tube;

feeding, sealing, and cutting the continuous open tube over a bottom web across the width of the bottom web;

sealing a top web over the continuous open tube so that the continuous open tube is configured between the bottom web and the top web; and slitting the continuous open tube configured between the bottom web and the top web to form the flexible package with the integrated handle on the at least one side gusset of the flexible package wherein the cover patch overlaps the edges of the integrated handle all around but does not overlap the entire width of the at least one side gusset of the flexible package.

2. The method of claim 1, wherein the continuous open tube is fed over and across a width of a bottom web and then cut to form the side gussets of the flexible package with integrated handle.

3. The method of claim 1, wherein sealing the handle patch further comprises:

pulling the side gusset laminate from a side gusset laminate roll; and pulling and cutting handle patch web from a roll to form the handle patch for sealing.

4. The method of claim 1, wherein sealing the cover patch further comprises pulling and cutting a cover patch web from a roll to form the cover patch for sealing.

5. The method of claim 1, wherein the cover patch is larger than the handle patch all around.

6. The method of claim 1, wherein the handle patch is made up of at least one of a polyethylene film or multilayer film or laminate with layers of polyethylene on two sides.

7. The method of claim 1, wherein the cover patch is made up of at least one of a film of polyethylene or multilayer film/laminate having polyethylene layer on at least one side, wherein the polyethylene layer on one side is provided to seal the cover patch to the handle patch and the side gusset laminate.

8. The method of claim 1, wherein the side gusset laminate is made up of at least one or a combination of a polymeric film, a metal foil, a laminate and a fibrous substrate, wherein the fibrous substrate being at least one of coated or uncoated paper, paperboard, non-woven, woven substrate of synthetic fibers or tapes, provided with polyethylene layer on at least one side to seal the side gusset laminate to the handle patch and the cover patch.

9. The method of claim 1, wherein the end portions of the sealed area of the handle patch are sealed to the side gusset laminate across the entire width of the handle patch.

* * * * *